US006883515B2

(12) United States Patent
Kuttalek

(10) Patent No.: US 6,883,515 B2
(45) Date of Patent: Apr. 26, 2005

(54) COOKING DEVICE

(75) Inventor: Edmund Kuttalek, Grassau (DE)

(73) Assignee: BSH Bosch und Siemens Hausgeräte, GmbH, Munich (DE)

( * ) Notice: Subject to any disclaimer, the term of this patent is extended or adjusted under 35 U.S.C. 154(b) by 0 days.

(21) Appl. No.: 10/459,814

(22) Filed: Jun. 12, 2003

(65) Prior Publication Data

US 2004/0050379 A1 Mar. 18, 2004

(51) Int. Cl.[7] ..... F24C 15/02; A21B 3/02
(52) U.S. Cl. ..... 126/190; 49/26
(58) Field of Search ..... 126/190, 273 R; 49/26–28, 31

(56) References Cited

U.S. PATENT DOCUMENTS 2,843,690 A * 7/1958 Miller ..... 49/27
2,944,540 A 7/1960 Littell
3,168,165 A * 2/1965 Bagnasco ..... 49/27
4,922,168 A * 5/1990 Waggamon et al. ..... 49/26
5,728,984 A * 3/1998 Miller ..... 49/28
5,962,825 A * 10/1999 Miller ..... 49/26

FOREIGN PATENT DOCUMENTS

JP 3-45820 A * 2/1991
JP 5-240448 A * 9/1993

* cited by examiner

*Primary Examiner*—Sara Clarke
(74) *Attorney, Agent, or Firm*—John T. Winburn

(57) ABSTRACT

A cooking device with a muffle bounding a cooking space, a linear door for closing a muffle opening and a drive device for moving the linear door to open or close the cooking space. In order to increase the operational reliability the cooking device has an anti-trapping device which detects an object outside the muffle opening between the inside of the linear door and a front face of the muffle frame. The anti-trapping device prevents trapping of the object between the linear door and the front face of the muffle frame when the object is detected.

15 Claims, 16 Drawing Sheets

COOKING DEVICE

Figure 1:
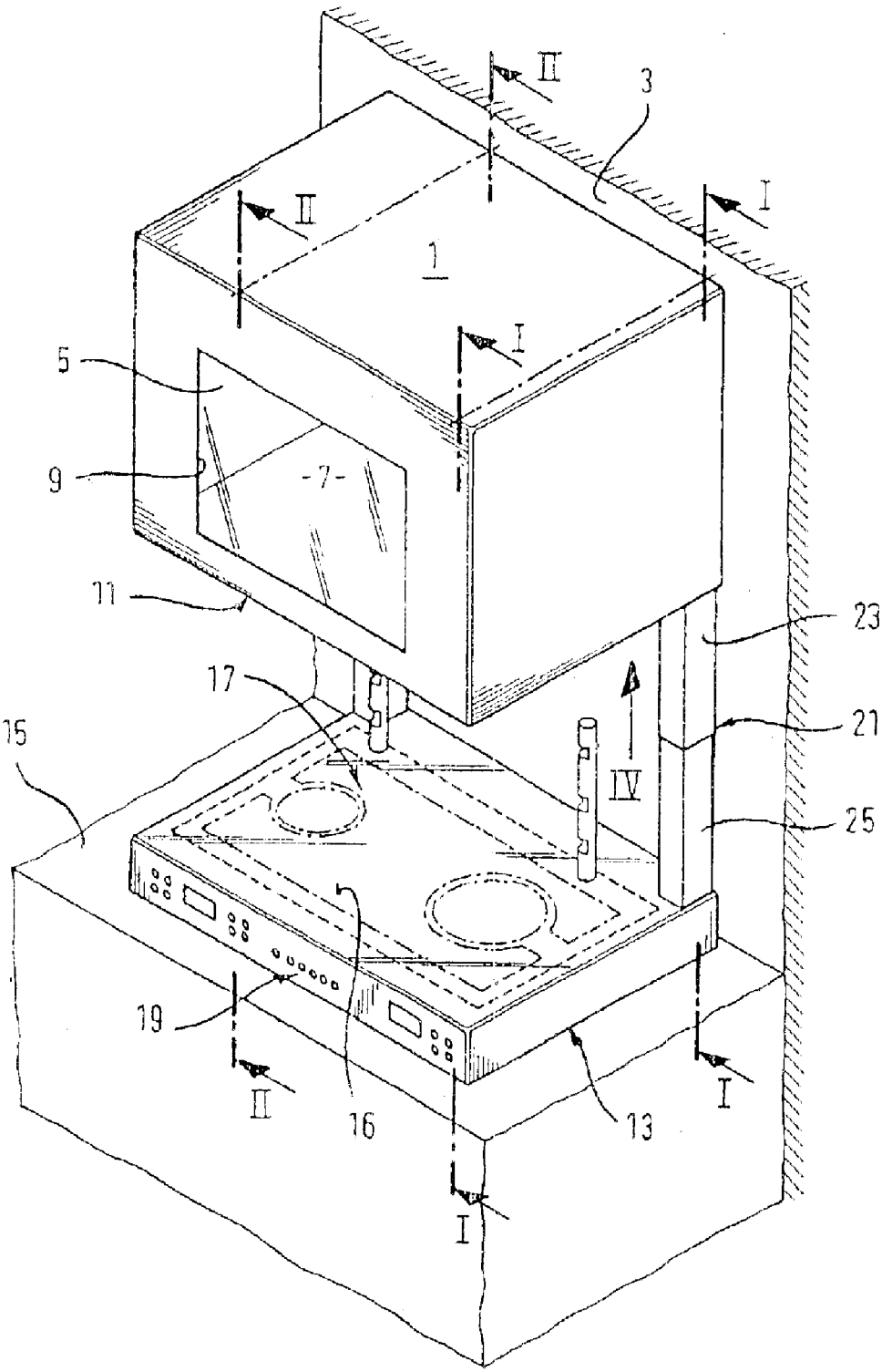

The present invention concerns a cooking device with a muffle bounding at cooking space, a linear door for closing a muffle opening and a drive device for moving the linear door, which lies, with its inside facing the cooking space, opposite a front face of a muffle frame running around the muffle opening when the cooking space is closed.

A generic cooking device is known from U.S. Pat. No. 2,944,540, which is designed as a high-level built-in cooking device. The cooking device has a bottom muffle opening, which is closable by a bottom door. The cooking device has an electric motor for the lifting movement of the bottom door. The opened and closed state of the door is monitored by means of limit switches, which are arranged on a rear wall of the oven. In the closed state of the door, a first switch is actuated in order to stop the electric motor. In the opened state of the bottom door, a second switch is actuated in order to stop the motor.

The problem of the present invention consists in providing a cooking device with improved operational reliability.

A cooking device has an anti-trapping device which monitors an intermediate space between the muffle opening and the motor-driven linear door. When an object or a body part of an operator is detected in the intermediate space, the anti-trapping device controls the linear door in a suitable manner in order to prevent trapping of the object. According to the invention, the intermediate space between the muffle frame and the linear door is directly monitored. The anti-trapping device therefore rapidly and unequivocally detects the object present in the intermediate space. In contrast, an indirect detection of the object, perhaps by monitoring of, for example, the magnitude of the motive power for the linear door, is disadvantageous. Such monitoring of the motive power is bound up with uncertainty factors, inasmuch as the intermediate space is not monitored directly. Linear door is understood, according to the invention, to mean both a horizontally displaceable baking trolley door as well as a vertically displaceable bottom door of a high-level built-in cooking device.

It is advantageous for the anti-trapping device to be an anti-trapping switch, which detects pressure exerted on the front face of the muffle frame. When a pressure exerted by the object is detected, the anti-trapping device controls the drive device of the door in a suitable manner. This prevents the object being trapped between the linear door and the muffle frame.

For safety reasons, it is particularly advantageous for the anti-trapping switch to run essentially in the form of a frame around the whole muffle opening, in particular along sides of the muffle opening accessible to the operator.

In a further example of embodiment of the invention, the anti trapping switch comprises a number of switch elements, which can be actuated independently of one another. If, therefore, one of the switch elements is not in working order on account of soiling, the remaining operational switch elements maintain a protection against trapping at least to a limited extent.

For example, the switch elements independent of one another can be arranged on the one hand on an outer closing edge and on the other hand also on an inner closing edge of the cooking device. Body parts projecting into the cooking device from outside as well as cooking containers projecting out of the cooking device can thus be reliably detected.

In a further embodiment, the switch elements independent of one another can run in a peripheral direction around the muffle opening. A time lag of the switch signals generated by the switch elements is detected by the anti-trapping device. With a large time lag, the anti-trapping device detects the object between the linear door and the front face of the muffle frame. If, on the other hand, the time lag is smaller than a predetermined threshold value, the anti-trapping device detects that the linear door has been moved into the closed position.

In a particularly simple embodiment, the anti-trapping switch is designed as a height-adjustable switch lever. When pressure is exerted, the switch lever actuates the anti-trapping device directly and without delay.

In order that the drive device responds directly and without delay following the actuation of the anti-trapping switch, short transmission paths are necessary between the limit switch and the drive device. This can be achieved if the limit switch is connected to the drive device via a lead-through opening formed in the muffle frame on the front face. In addition, the height-adjustable switch lever can be held in a non-actuated position by its intrinsic weight solely as a result of gravity. To actuate the switch lever, its intrinsic weight alone has to be overcome. When produced from a light material, the switch lever is thus highly response-sensitive.

The lead-through opening of the switch lever can be advantageously arranged outside a ring seal surrounding the muffle opening. A heat loss from the cooking space through the lead-through opening into the interior of the cooking device is thus avoided.

It is particularly advantageous for the anti-trapping switch to be arranged, in the direction of the linear door, preferably approx. 2–3 mm behind a front face of the ring seal. As a result, the anti-trapping switch cannot be actuated until the object or the linear door exceeds a minimum compression depth of the seal. With a suitable design of the seal, the linear door is switched off by a limit switch in the closing procedure even before the minimum compression depth is reached. In contrast, the minimum compression depth of the seal is only exceeded if an object with a relatively small contact area presses against the seal.

In the above case, the type of control of the drive device depends on whether the limit switch or the anti-trapping switch is actuated: when the limit switch is actuated, the closed position of the linear door is ascertained and the drive device switched off. When the anti-trapping switch is actuated, the anti-trapping device detects an object and the drive of the linear door is reversed.

In a further form of embodiment, the anti-trapping switch is designed as an easily installable rubber hollow section with at least one pressure detection chamber. The pressure detection chamber is in pneumatic connection with the anti-trapping device. The drive device of the linear door is suitably controlled according to a pressure increase in the pressure detection chamber. The shaping of the rubber hollow section can, to advantage, easily be adapted to the circumstances at the front face of the muffle frame.

It is advantageous for the rubber hollow section also to be designed as a ring seal, which seals off the closed cooking space. An additional ring seal between the linear door and muffle frame can thus be dispensed with.

Depending on the pressure increase in the rubber hollow section as a function of time, the anti-trapping device can to advantage distinguish whether the increase in pressure is due to a heating effect from the cooking device or to an object or a body part. If there is a fairly large gradient of the pressure increase as a function of time, the anti-trapping device detects an object. If there is a relatively small gradient of the pressure increase as a function of time, the anti-trapping device detects a pressure increase produced by a heating effect of the cooking device. In such a case, the drive device is not triggered by the anti-trapping device.

According to a further form of embodiment, the anti-trapping device can have electrically conductive contact elements. The contact elements come into contact with one another even with a small exertion of pressure by the object and convey a corresponding switch signal to the anti-trapping device. To advantage, lead-through openings in the front face of the muffle frame can be dispensed with for the signal connection between the anti-trapping switch and the anti-trapping device.

According to a special embodiment of the invention, an optoelectronic sensor is used for detecting the object. The sensor monitors the intermediate space outside the muffle opening between the linear door and the muffle frame. When a light transmission path of the sensor is interrupted, the anti-trapping device controls the drive device of the linear door in a suitable manner. In contrast with the previous examples of embodiment, the detection of the object takes place without the object coming into contact with the muffle frame.

Figure 2:
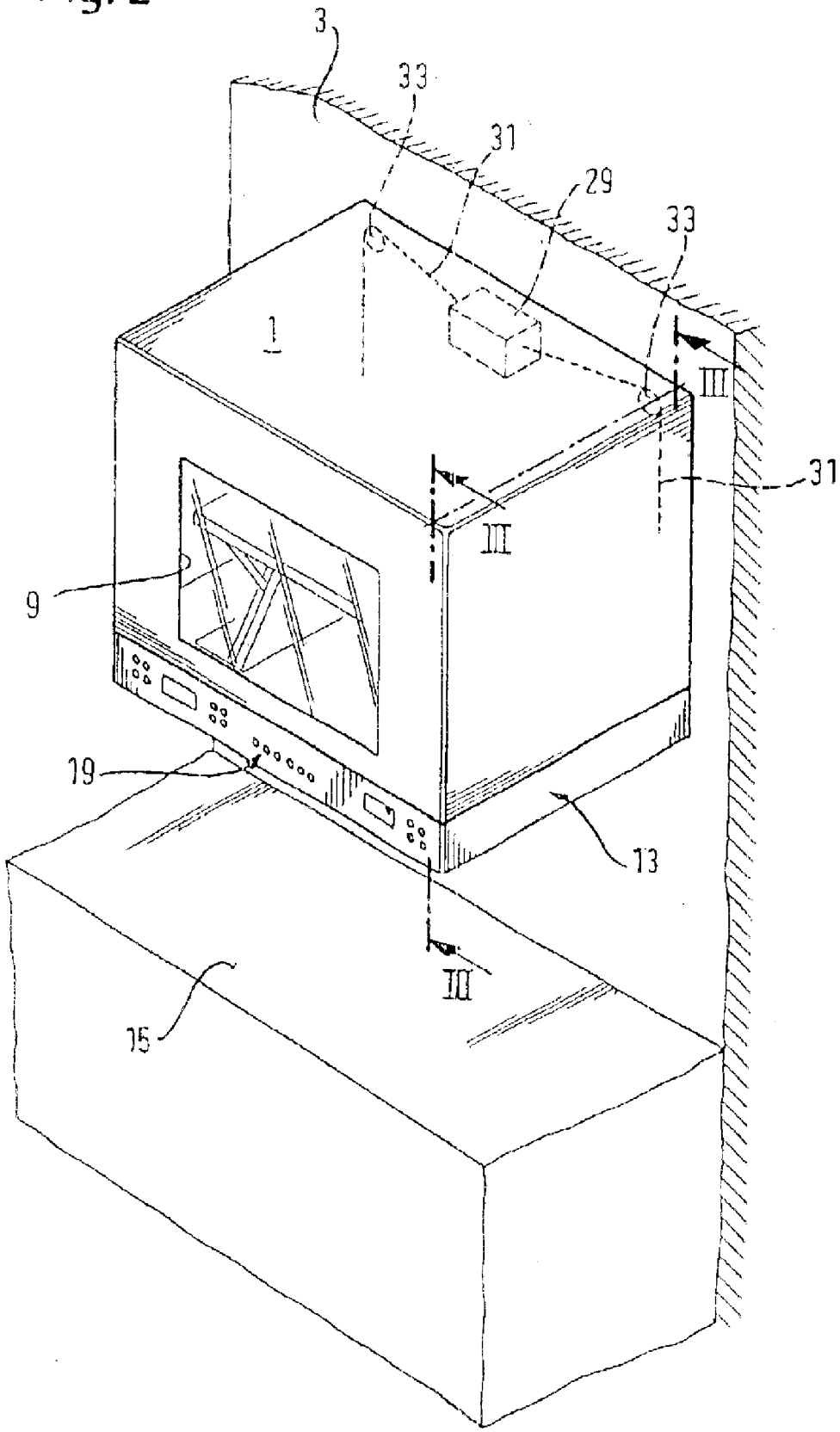
Figure 3:
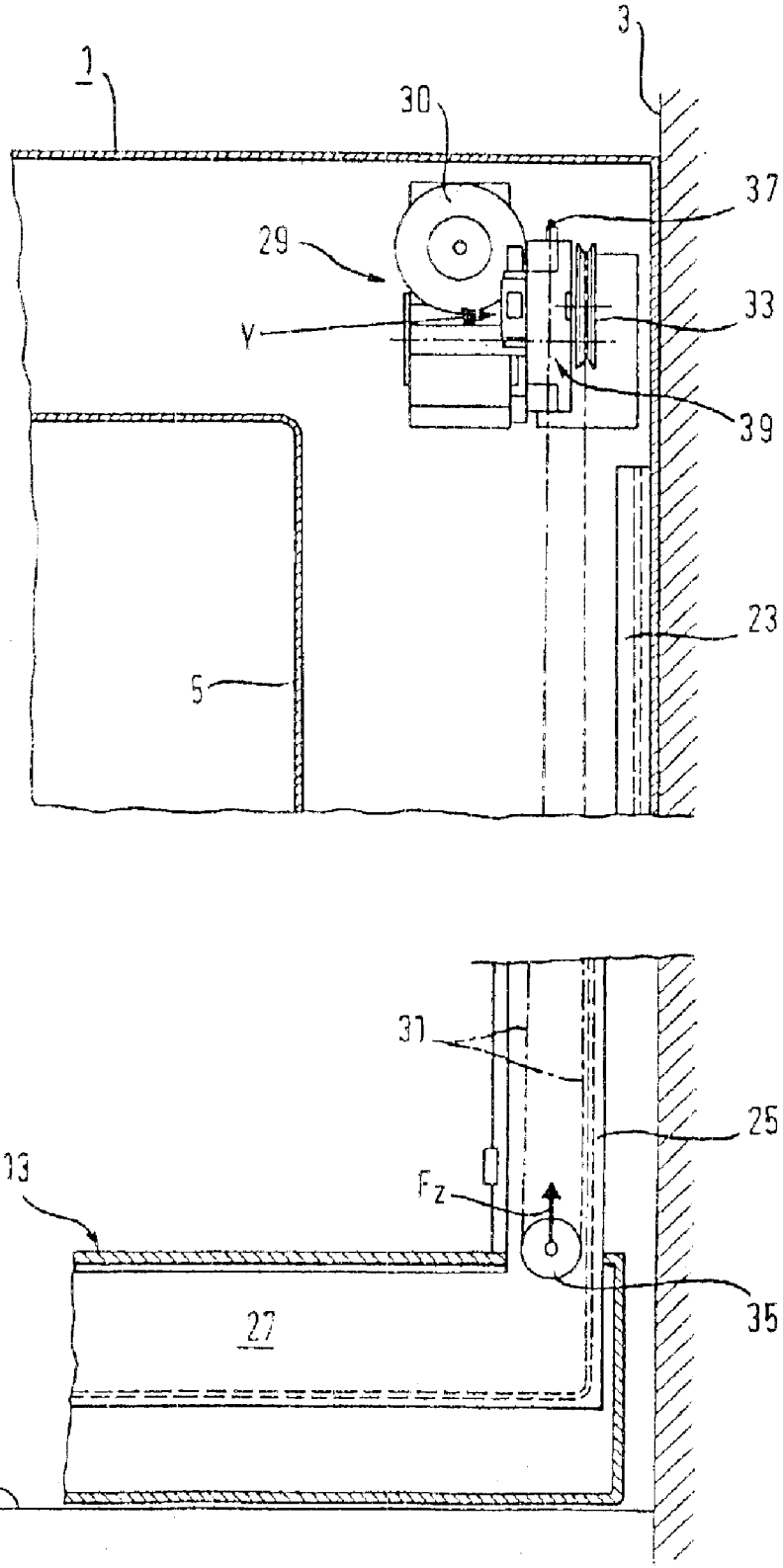
Figure 4:
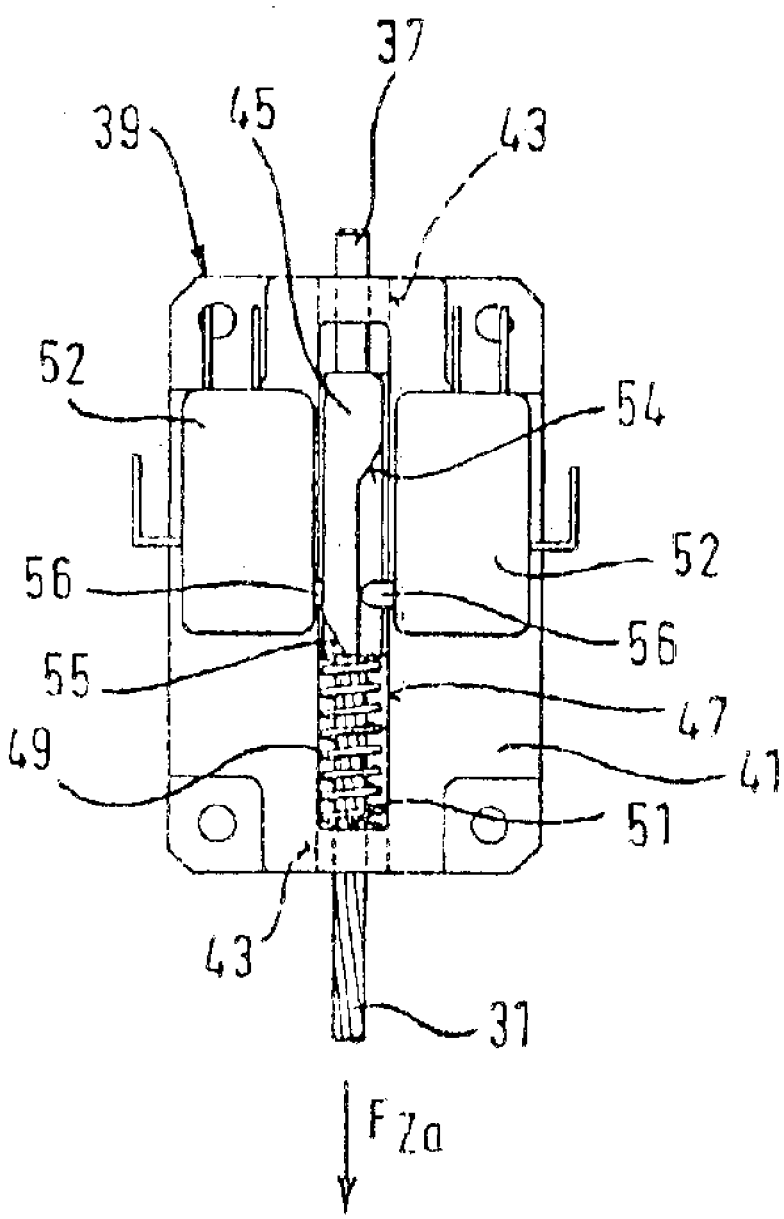
Figure 5:
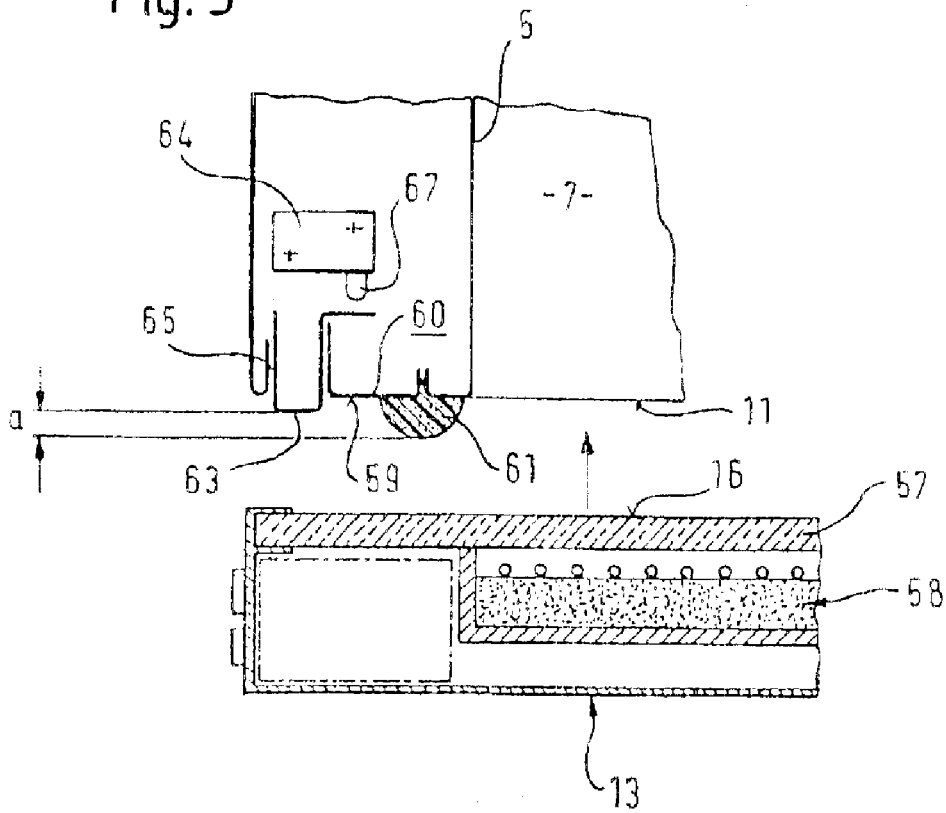
Figure 6:
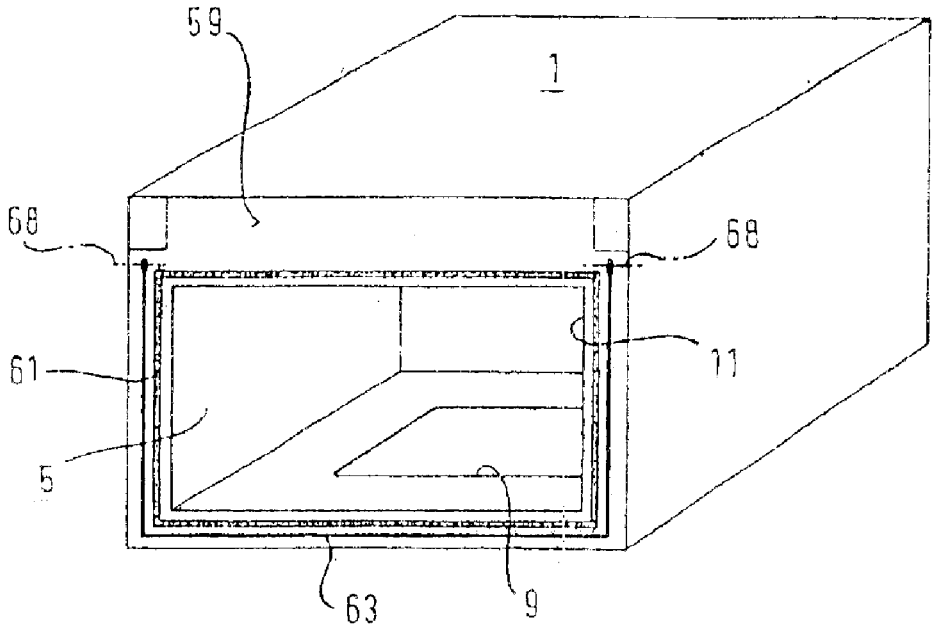
Figure 7:
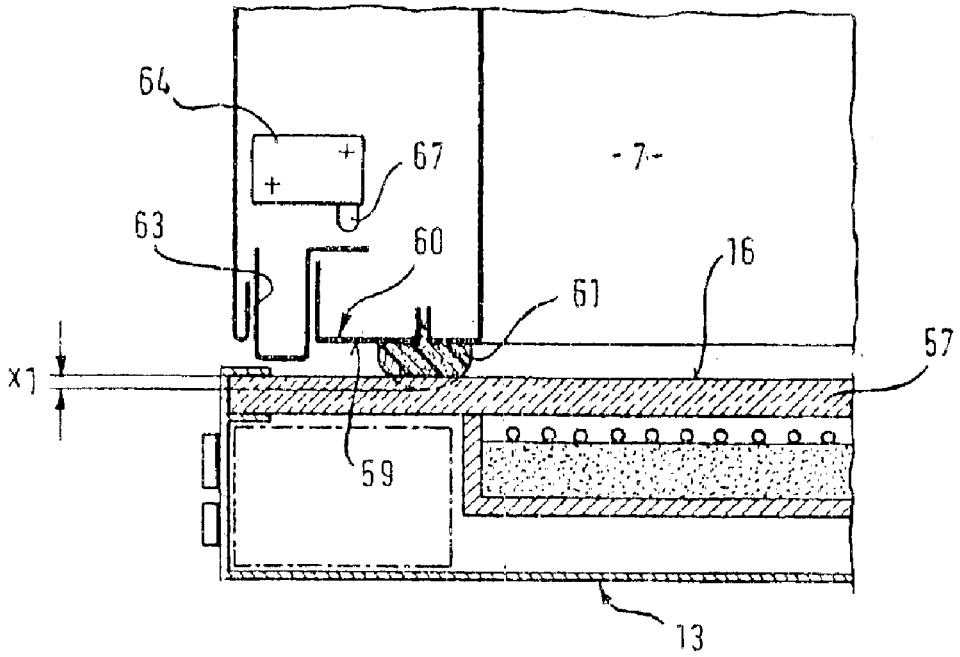
Figure 8:
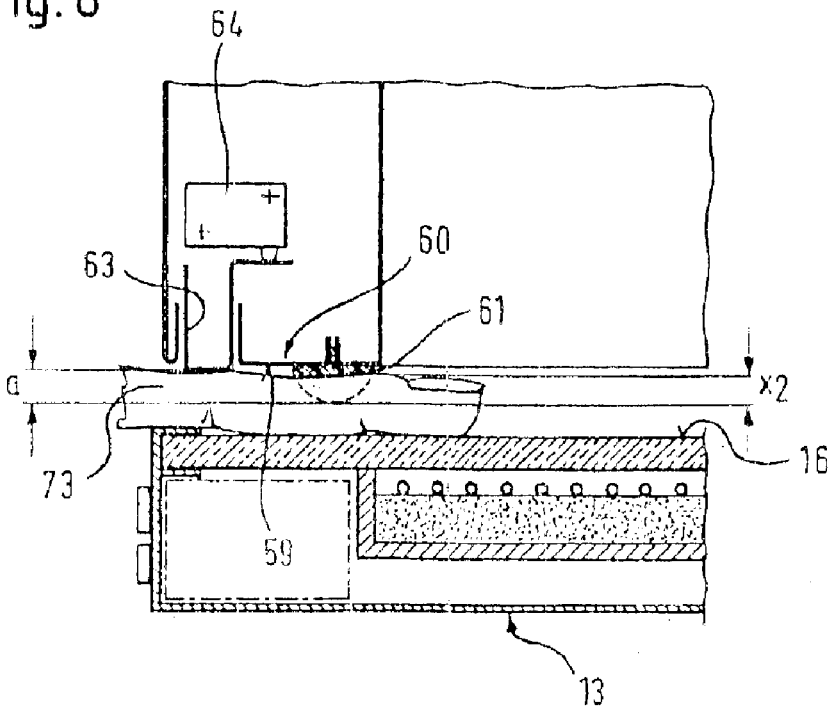
Figure 9:
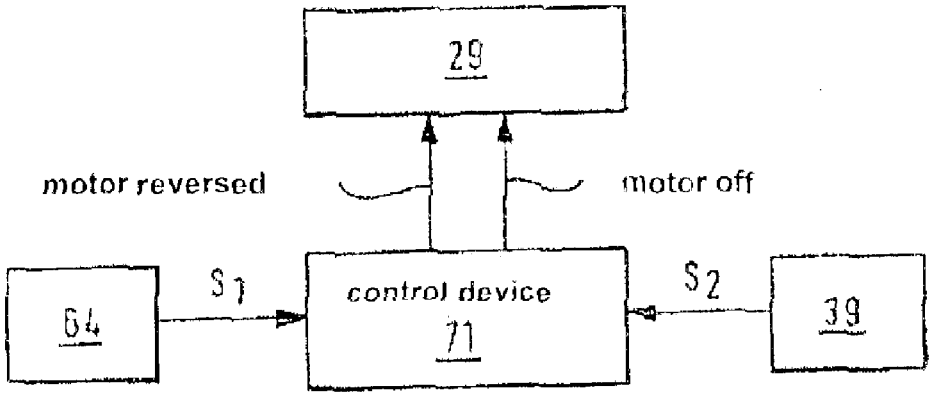
Figure 10:
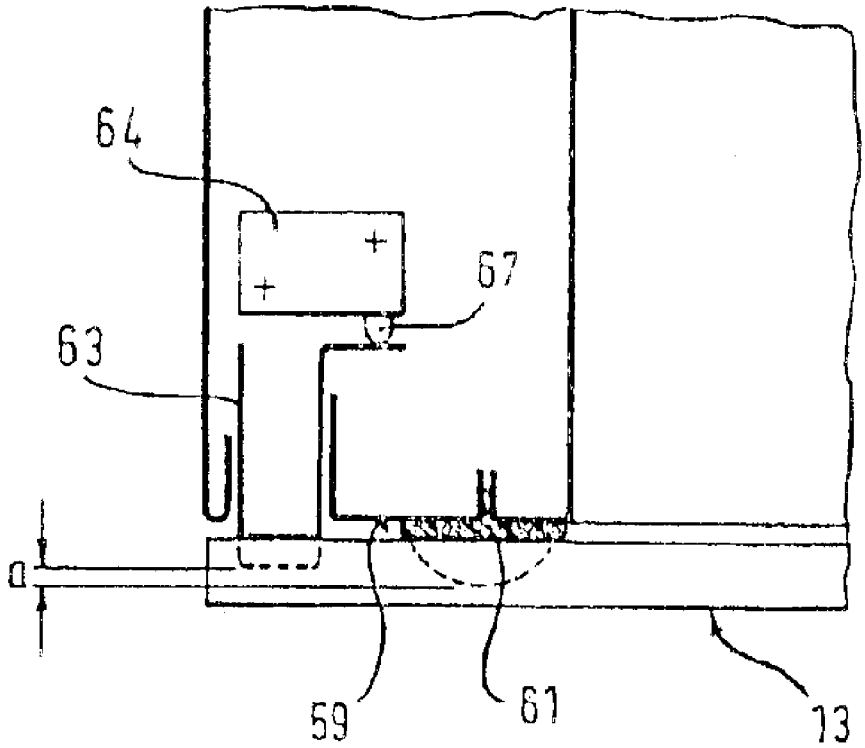
Figure 11:
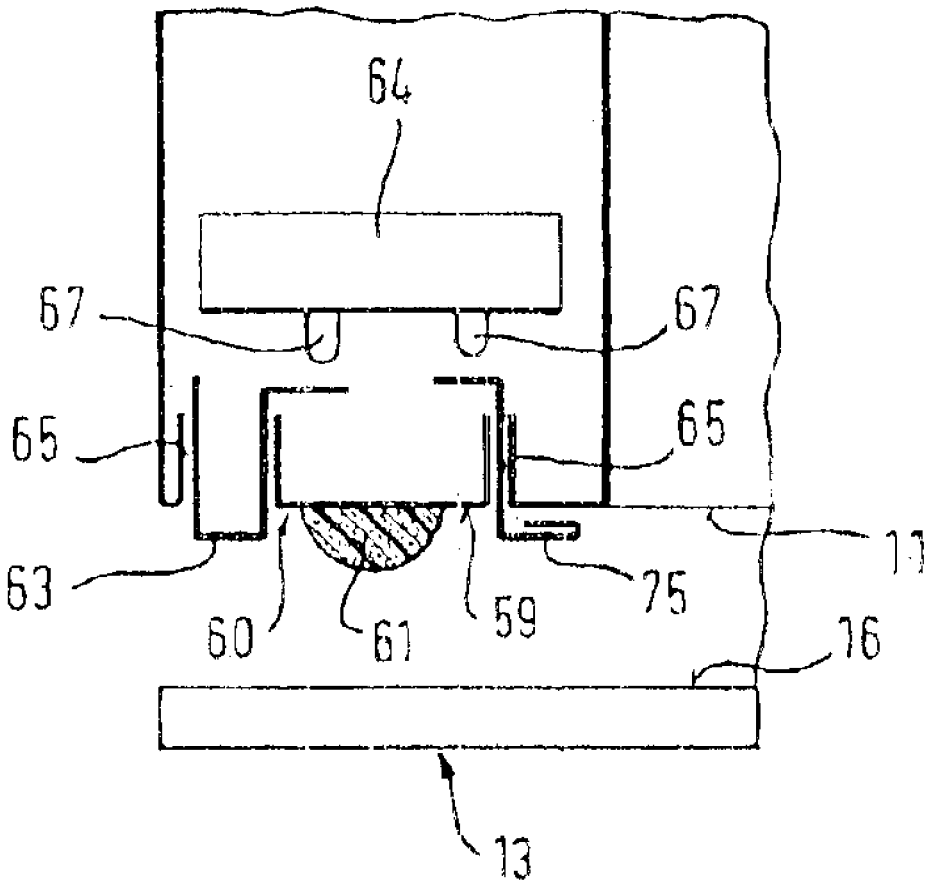
Figure 12:
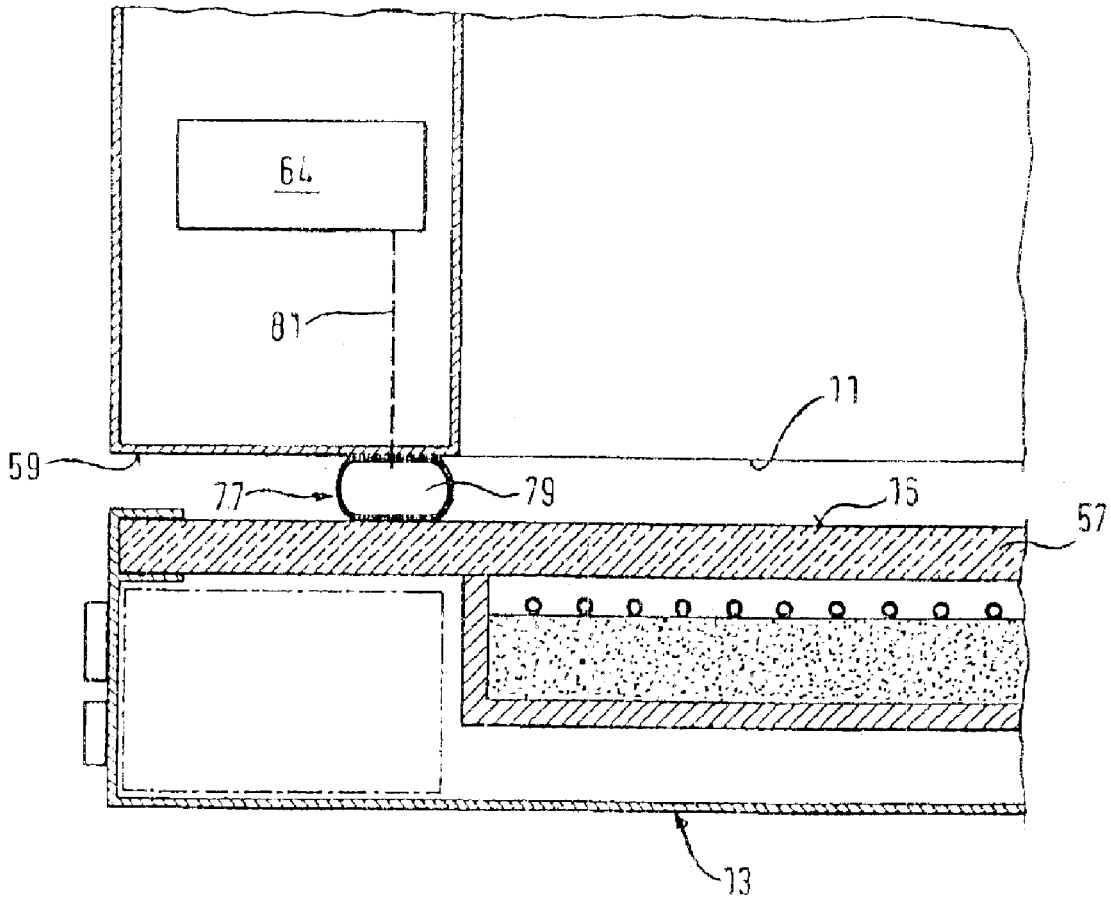
Figure 13:
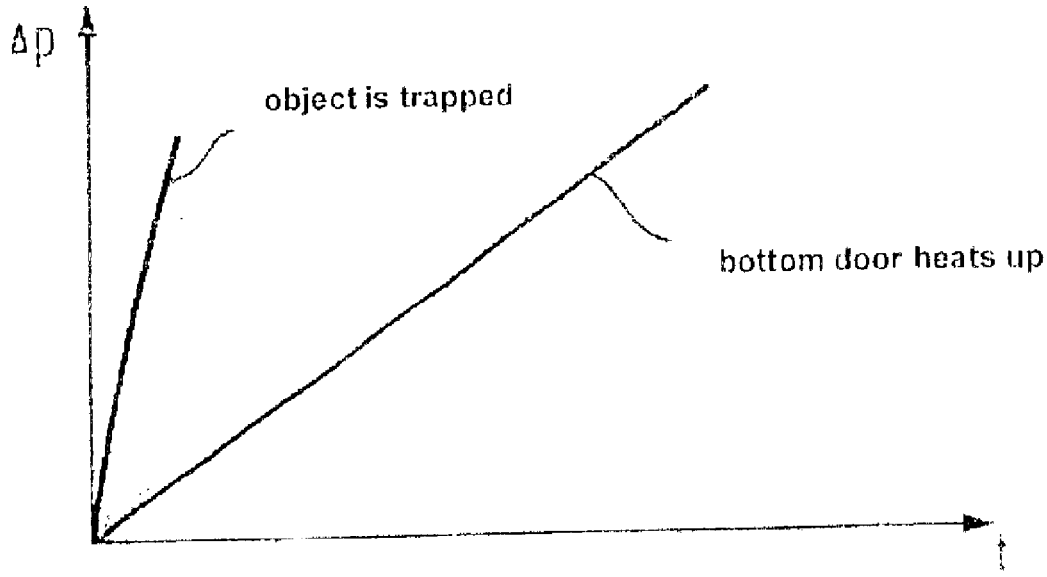
Figure 14:
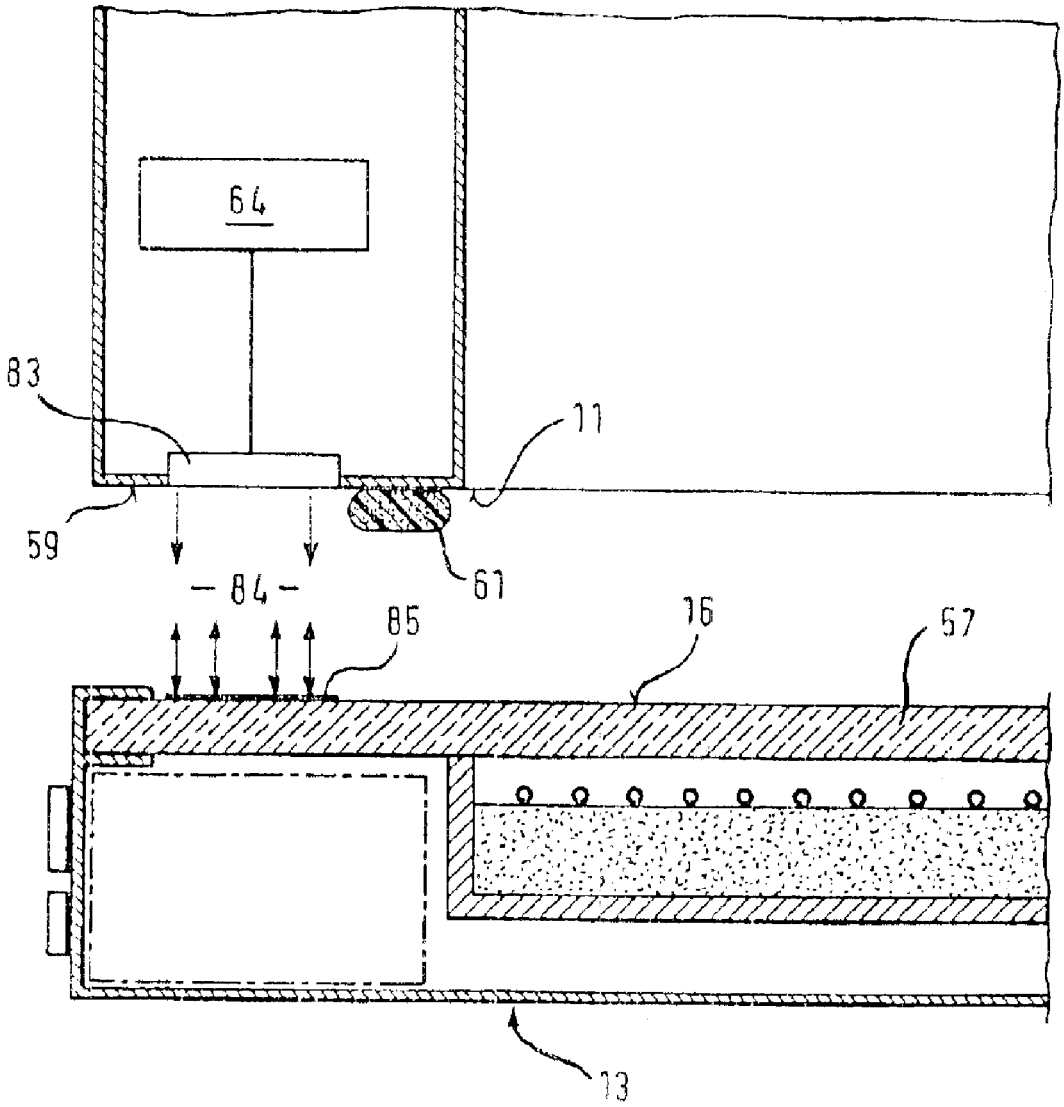
Figure 15:
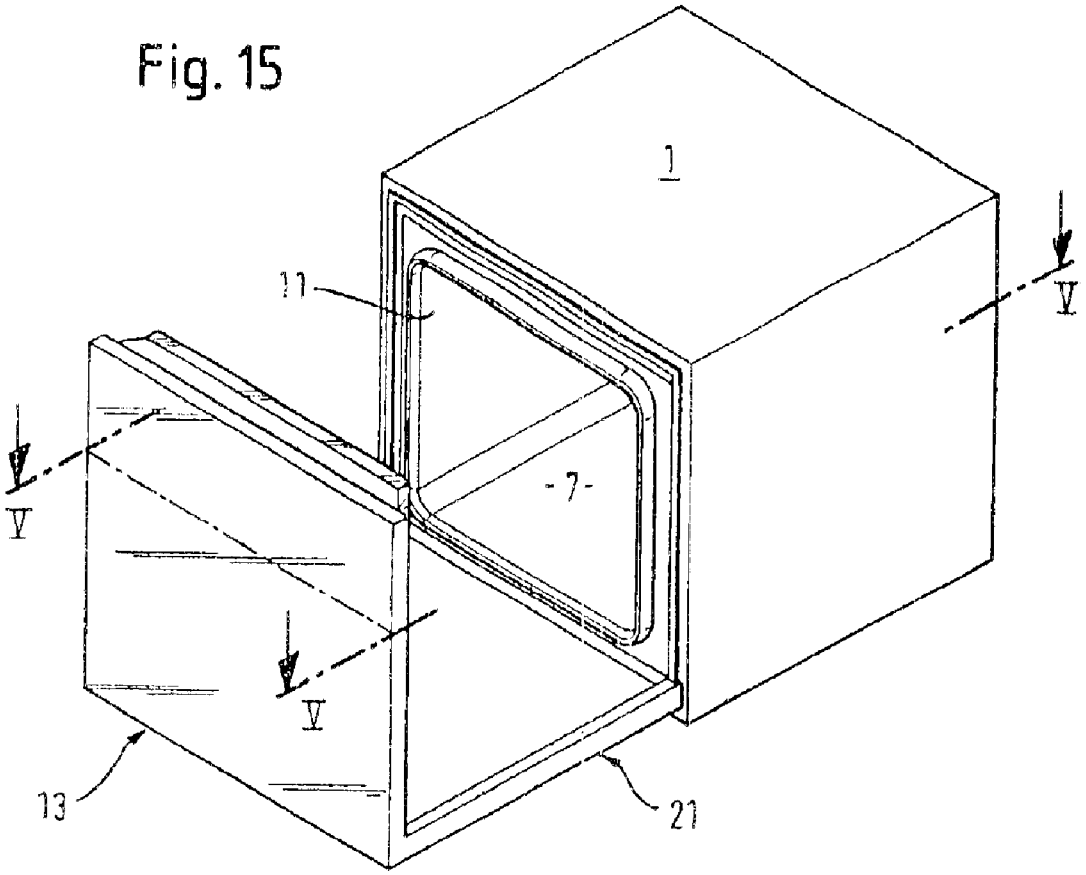
Figure 16:
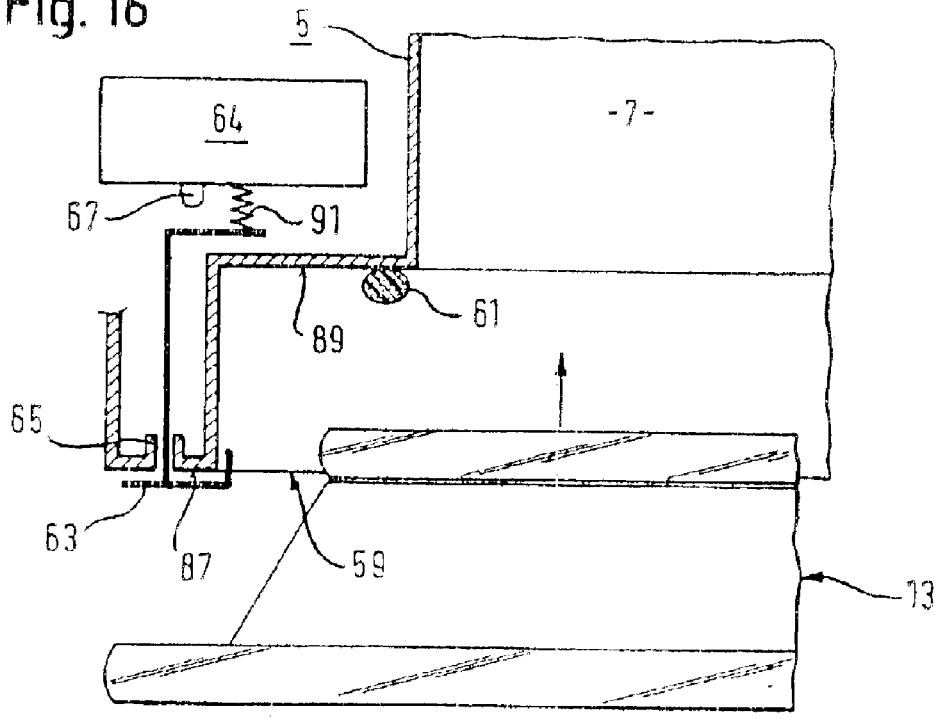
Figure 17:
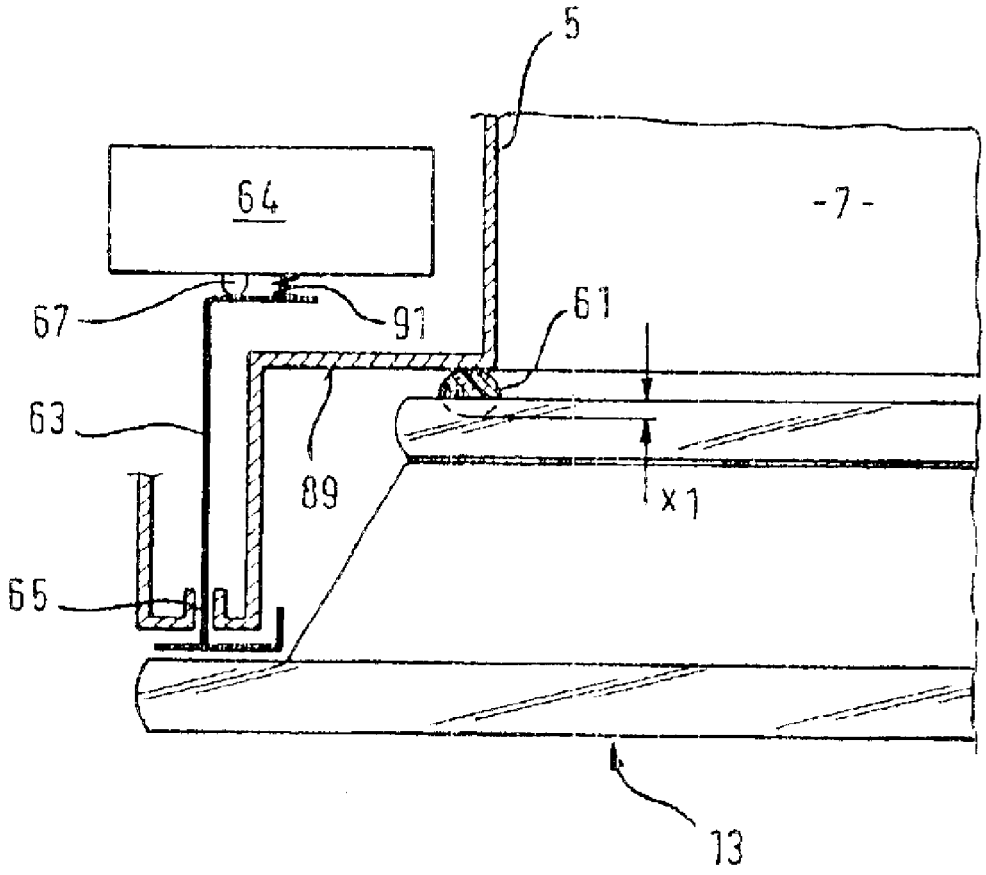
Figure 18:
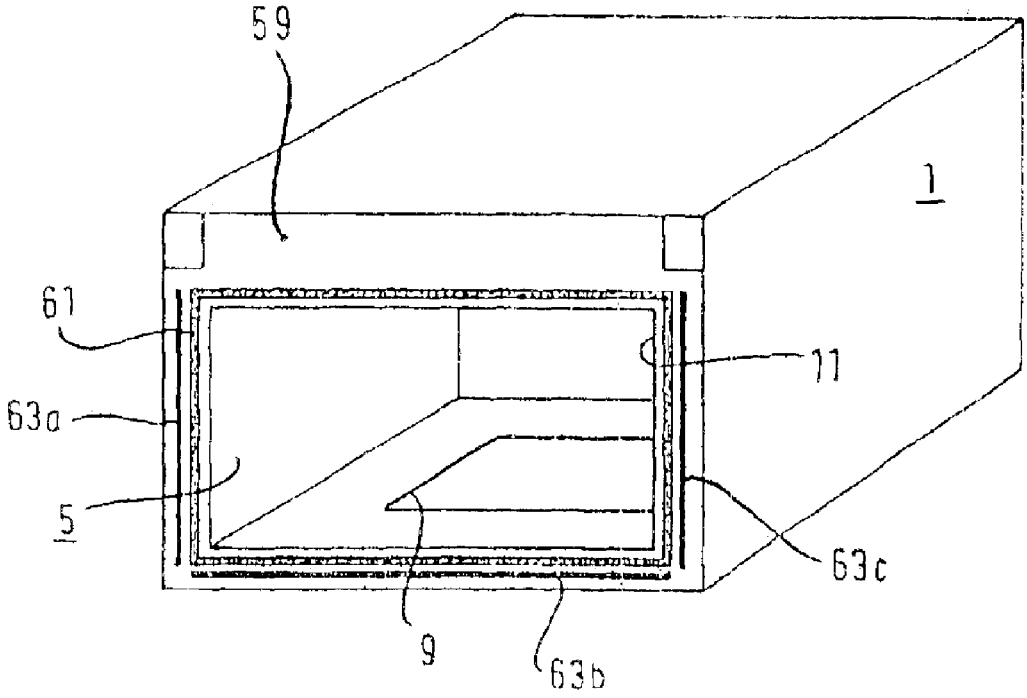
Figure 19:
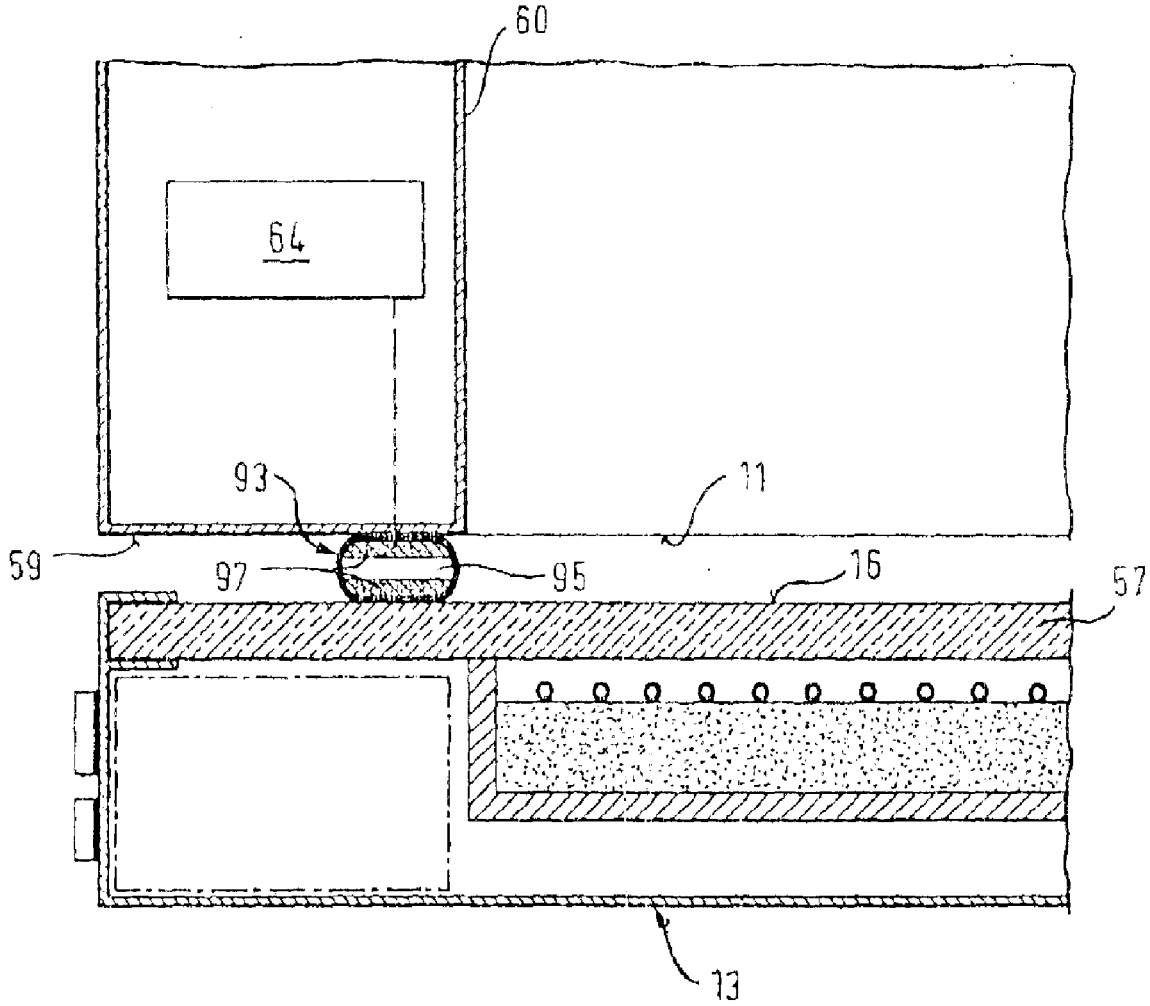

Eight examples of embodiment of the invention are described below with the aid of the appended figures. They show the following:

FIG. 1 a perspective view of a high-level built-in cooking device mounted on a vertical wall with lowered bottom door according to the first example of embodiment;

FIG. 2 a view of the high-level built-in cooking device according to FIG. 1 with closed bottom door;

FIG. 3 an enlarged cut-out from a side sectional view along sectional plane I—I from FIG. 1;

FIG. 4 a detail Y from FIG. 3 in an enlarged front view;

FIG. 5 an enlarged cut-out from a side sectional view along sectional plane II—II from FIG. 1;

FIG. 6 a view of a housing of the high-level built-in cooking device in the direction of arrow VI from FIG. 1;

FIG. 7 an enlarged cut—out from a side sectional view along sectional plane III—III from FIG. 2;

FIG. 8 an enlarged cut-out from a side sectional view along sectional plane III—III from FIG. 2;

FIG. 9 a block diagram, which illustrates a control of a drive motor for the bottom door;

FIG. 10 the second example of embodiment in an enlarged cut-out from a side sectional view along sectional plane III—III from FIG. 2;

FIG. 11 the third example of embodiment in an enlarged cut-out from a side sectional view along sectional plane II—II from FIG. 1;

FIG. 12 the fourth example of embodiment in an enlarged cut-out from a side sectional view along sectional plane III—III from FIG. 2;

FIG. 13 a diagram assigned to the anti-trapping device of the fourth example of embodiment;

FIG. 14 the fifth example of embodiment in an enlarged cut-out from a side sectional view along sectional plane II—II from FIG. 1;

FIG. 15 a cooking device with baking trolley door according to the sixth example of embodiment in perspective view;

FIG. 16 an enlarged cut-out from a side sectional view along sectional plane V—V from FIG. 15;

FIG. 17 a view according to FIG. 16 with closed cooking space;

FIG. 18 a view according to FIG. 6 according to the seventh example of embodiment; and FIG. 19 the eighth example of embodiment in an enlarged cut-out from a side sectional view along sectional plane III—III from FIG. 2.

The cooking device according to the invention is shown in FIG. 1 as a high-level built-in cooking device with a housing 1, according to the first example of embodiment. The rear side of housing 1 is mounted on a vertical kitchen wall 3 in the manner of a suspended cabinet. Housing 1 has a muffle 5, which bounds cooking space 7. Cooking space 7 can be checked through an inspection window 9 fitted in housing 1 on the front side. Muffle 5 is surrounded by a heat-insulating casing (not shown) and has a muffle opening 11 in the bottom. This can be closed with a lowerable linear or bottom door 13. Bottom door 13 is shown in a lowered state in FIG. 1. Accordingly, bottom door 13 lies with its lower side on a working plate 15 of a kitchen fitting. In the upper side 16 of bottom door 9 facing muffle opening 11, there is provided a cooking panel 17, which according to FIG. 1 has two cooking areas lying beside one another. Cooking panel 17 can be operated via a control panel 19, which is provided on a front side of bottom door 13.

As can be seen from FIG. 1, bottom door 13 is connected with housing 1 on both sides of the high-level built-in cooking device by means of lateral telescoping rods 21. By means of telescoping rod 21, bottom door 13 can be adjusted from the lowered state in FIG. 1 into a raised state, which is shown in FIG. 2. For the adjustment of bottom door 13, each of the telescoping rods 21 has a telescoping rail 23 attached to housing 1 and a second telescoping rail 25 attached to bottom door 13. The two telescoping rails 23 and 25 are connected to one another in a longitudinally displaceable manner. First telescoping rail 23 is mounted rigidly at the rear wall of the housing in the side sectional view of FIG. 3, enlarged in sections. Second telescoping rail 25 on the bottom door is designed as an L-shaped support. With its horizontal support leg 31, the L-shaped support engages with bottom door 13 in order to support the latter.

As shown in FIG. 3, there is arranged inside housing 1 a drive device 29, in the present case an electric motor, for the lifting movement of bottom door 13. This is in a signal connection with control panel 19 on bottom door 13 via current and/or signal lines (not shown). Electric motor 29 is indicated in FIG. 2 with dashed lines in the area of the rear wall of the housing roughly in the middle between the two side walls of housing 1. Depending on the desired direction of the travelling movement of bottom door 13, electric motor 29 can wind up or unwind traction rope 31 via a rope drum 30 (FIG. 3). Traction ropes 31 are guided from centrally arranged electric motor 29 first horizontally to laterally arranged deflection rollers 33 on the housing, such as are indicated in FIG. 2. Deflection rollers 33 on the housing deflect traction rope 31 in the vertical direction to further deflection rollers 35, which are fitted on the bottom door. According to FIG. 3, deflection rollers 35 on the bottom door are fitted inside second telescoping rails 25. Traction ropes 31 run inside telescoping rails 23, 25. Traction rope 31 is guided in the manner of a pulley block around deflection roller 35 on the bottom door and again deflected into housing 1. End 37 of traction rope 31 is secured to a limit switch 39 fixed on the housing. According to FIG. 3, said limit switch is arranged inside housing 1 at roughly at the same height as deflection rollers 33 on the housing.

The structure and mode of operation of limit switch 39 is described in the following with the aid of FIG. 4, which shows a detail Y from FIG. 3. Limit switch 39 has a vertical support plate 41 with a centrally arranged vertical hole 43. End 37 of the traction rope is guided through hole 43. A switch lug 45 is fixed to end 37 of the traction rope. Said lug projects through a switch window 47 provided at the front side of vertical support plate 41. Switch lug 45 is guided in a vertically displaceable manner inside switch window 47. Switch lug 45 is supported via a spring 49 on a lower supporting face 51 of switch window 47. Switches 52 lying opposite one another are triggered by means of switch lug 45. For this purpose, switch lug 45 has two switch ramps 54, 55 lying opposite one another, which are offset with respect to one another in the longitudinal direction of traction rope 31. Depending on a height position of switch lug 45, switch ramps 54, 55 switch two tripping pins 56 of switch 52 lying opposite one another.

In FIG. 4, left-hand tripping pin 56 of switch 52 is actuated by switch lug 45. This is the case when a downwardly directed tractive force $F_{Za}$ of traction rope 31 is greater than an opposing spring tension, which is exerted by spring 49 on switch lug 45. Furthermore, right-hand tripping pin 56 shown in FIG. 4 is out of engagement with switch lug 45. That is to say, tractive force $F_{Za}$ of traction rope 31 is smaller than the spring tension exerted by spring 49 on the switch lug. Right-hand tripping pin 56 in FIG. 4 is only actuated by switch lug 45 when tractive force $F_{Za}$ of traction rope 31 is greater than the spring tension. This is the case when bottom door 13 travels against an upper stop during closure of cooker space 7. Traction rope 31 then presses switch lug 45 downwards against spring 49, as a result of which right-hand tripping pin 56 is actuated. Electric motor 29 is switched off by the actuation of right-hand tripping pin 56.

Bottom door 13 and housing 1 of the high-level built-in cooking device are shown in FIG. 5 in an enlarged side sectional view along line II—II from FIG. 1. Upper side 16 of bottom door 13 is formed by a glass ceramic plate 57. A heating element 58 is arranged beneath glass ceramic plate 57 in order to form one of the cooking areas. Glass ceramic plate 57 lies opposite a front face 59 of a muffle frame 60. On front face 59 of muffle frame 60 there is fitted a ring seal 61, which runs in the form of a frame around muffle opening 11. An anti-trapping switch 63 of an anti-trapping device 64 is arranged outside ring seal 61. By means of anti-trapping device 64, an object or a body part can be detected outside muffle opening 11 between upper side 16 of bottom door 13 and front face 59 of muffle frame 60. After the detection, anti-trapping device 64 prevents trapping of the object between bottom door 13 and front face 59 of muffle frame 60 by means of a suitable actuation of electric motor 29.

Anti-trapping switch 63 according to FIG. 5 is designed as a height-adjustable switch lever. Switch lever 63 is produced from a light sheet metal and is formed U-shaped in cross-sectional profile. A lower front face of U-profile-shaped switch lever 63 lies opposite upper side 16 of bottom door 13. The legs of U-profile-shaped switch lever 63 parallel to one another project through lead-through opening 65 in front face 59 of muffle frame 60 into a housing interior. In order to guide switch leader 63 through lead-through opening 65, guide walls of lead-through opening 65 lie opposite its parallel legs. A shoulder bent off at right angles is formed on the right-hand leg shown in FIG. 5 in the housing interior. The shoulder is out of contact with a tripping pin 67 of control device 64. Furthermore, due to the inherent weight of the switch lever, the shoulder lies reliably on one of the guide walls of lead-through opening 65. It can be seen from FIG. 5 that the front face of U-profile-shaped switch lever 63 is arranged a distance a of approx. 2–3 mm behind a front face of ring seal 61.

Housing 1 of high-level built-in cooking device is shown in a view from below in FIG. 6, bottom door 13 having been omitted. Accordingly, ring seal 61 arranged on front face 59 of muffle frame 60 completely surrounds muffle opening 11. Switch lever 63 runs outside ring seal 61 on the two sides of the high-level built-in cooking device and on the front side. Switch lever 63 is arranged on all sides of muffle opening 11 accessible to an operator. In the area of the rear wall of housing 1, switch lever 63 is additionally mounted in a swivelling manner by means of swivel pins 68.

A closing procedure of bottom door 13 shown opened in FIG. 5 is described below with the aid of FIGS. 5, 7 and 8. In order to move bottom door 13 into the closed position according to FIG. 7, laterally running traction ropes 31 are wound onto rope drum 30 of electric motor 29 shown in FIG. 3. As a result, a tractive force $F_z$ directed upwards is exerted on deflection roller 35 on the bottom door (FIG. 3). Bottom door 13 thus moves upwards. As soon as glass ceramic plate 57 of bottom door 13 comes into contact with ring seal 61, the value of tractive force $F_{Za}$ of traction rope 31 shown in FIG. 4 increases. End 37 of traction rope 31 held in limit switch 39 thus pulls switch lug 45 of limit switch 39 downwards. As a result, right-hand tripping pin 56 shown in FIG. 4 is actuated. Electric motor 29 is switched off by the actuation of right-hand tripping pin 56 of limit switch 39. In its closed position, bottom door 13 thus compresses, with a certain pressing force, ring seal 61 over a first compression depth $x_1$ (FIG. 7). First compression depth $x_1$ is correspondingly small on account of a large contact area between the ring seal and upper side 16 of bottom door 13. The spring tension of spring 49 of limit switch 39 is selected such that limit switch 39 switches off electric motor 29 before the magnitude of compression depth $x_1$ reaches the magnitude of distance a. In the closed position shown in FIG. 7, therefore, switch lever 59 is out of contact with bottom door 13. Limit switch 39 thus switches off electric motor 29 in the closed position of bottom door 13 independently of anti-tripping device 64.

In FIG. 8, the case is dealt with in which an object, for example a hand 73, lies between bottom door 13 and muffle frame, 60 during the closing procedure of bottom door 13. Accordingly, hand 73 is first brought into contact with ring seal 61 by bottom door 13. Said ring seal is compressed by hand 73 over a second compression depth $x_2$. On account of the small contact area between ring seal 61 and hand 73, second compression depth $x_2$ shown in FIG. 8 is much larger than first compression depth $x_1$. Thus, in FIG. 8, switch lever 63 is actuated even before limit switch 39 switches off electric motor 29. Limit switch 39 is not actuated in the state shown in FIG. 8, since the tractive force $F_{Za}$ of traction rope 31 is smaller than the spring tension of spring 49 of limit switch 39. When switch lever 63 is actuated, anti-trapping device 69 detects that hand 73 lies between bottom door 13 and front face 59 of muffle frame 60.

Signal paths from anti-trapping device 64 to drive motor 29 and from limit switch 39 to drive motor 29 are shown in a block diagram in FIG. 9. Accordingly, when an object is detected, switch signal $S_1$ is conveyed from anti-trapping device 64 first to a control device 71. Correspondingly, switch signal $S_2$ is conveyed from limit switch 39 to control device 71. If control device 71 receives switch signal $S_1$ from anti-trapping device 64, control device 71 reverses the drive motion of electric motor 29. The travelling motion of bottom door 13 is directed downwards as a result. Trapping of an object between bottom door 13 and muffle frame 60 is thus reliably prevented. In the case where control device 71 receives switch signal $S_2$, control device 71 switches off electric motor 29. In this case, bottom door 13 in its closed position is pressed with a prescribed force against front face 59 of muffle frame 60.

A high-level built-in cooking device according to the second example of embodiment is shown in FIG. 10. The structure of the high-level built-in cooking device according to the second example of embodiment essentially corresponds to the structure of the first example of embodiment. In contrast with the first example of embodiment, switch lever 63 is not only assigned to anti-trapping device 64, but switch lever 63 also acts as a limit switch. Limit switch 39 of the first example of embodiment is therefore omitted in the second example of embodiment. Switch lever 63 is on the one hand actuated when—as shown in FIG. 8—hand 73 lies between muffle frame 60 and bottom door 13. On the other hand, switch lever 63 according to FIG. 10 is actuated when the compression depth reached by bottom door 13 is greater than distance a and therefore comes into contact with restored switch lever 63.

In the third example of embodiment from FIG. 11, a further switch lever 75 is arranged inside ring seal 61, in addition to switch lever 63 arranged outside ring seal 61. Inner switch lever 75 is guided via a second lead-through opening 65 through front face 59 of muffle frame 60. In contrast with switch lever 63 arranged outside ring seal 61, switch lever 75 is formed L-shaped. A first leg of inner switch lever 75 lies opposite upper side 16 of bottom door 13. A second leg of inner switch lever 75 is guided through lead-through opening 65. The second leg has a bent-back switch shoulder, which is shown out of contact with tripping pin 67 of anti-trapping device 64. A peripheral edge of muffle frame 60 running around muffle opening 11 is additionally protected by inner switch lever 75. If a cooking container placed on bottom door 13 moves against muffle frame 60 during the closing procedure, at least inner switch lever 75 is thus actuated. Trapping of the object between bottom door 13 and muffle frame 60 is thus prevented.

A further high-level built-in cooking device according to a fourth example of embodiment is shown in FIG. 12. The structure of the high-level built-in cooking device according to the fourth example of embodiment essentially corresponds to the structure of the preceding examples of embodiment. In contrast therewith, anti-trapping switch of anti-trapping device 64 is not designed as a switch lever, but as a rubber hollow section 77 with at least one pressure detection chamber 79. Pressure detection chamber 79 is in a signal connection with anti-trapping device 64 via a pneumatic pressure line 81 indicated with dashed lines. Rubber hollow section 77 runs around muffle opening 11 and also acts, when the cooking space is closed, as a seal between bottom door 13 and muffle frame 60 on the front face. It is thus possible to dispense with an additional separate ring seal.

As shown in the diagram of FIG. 13, anti-trapping device 64 detects a pressure increase in pressure detection chamber 79 as a function of time. A first pressure increase curve with a large gradient angle and a second pressure increase curve with a smaller gradient angle are shown in the diagram. According to the invention, anti-trapping device 64 determines how electric motor 29 is controlled, in dependence on the gradient angle of the detected pressure increase curve. With a small gradient angle of the pressure increase curve, anti-trapping device 64 detects that the pressure increase results from a heating effect due to the cooking device. Electric motor 29 is not triggered in this case. With a large gradient angle of the pressure increase curve, anti-trapping device 64 detects that an object lies between bottom door 13 and the muffle frame. In such a case, the direction of the drive motion of electric motor 29 is reversed.

In the fifth example of embodiment from FIG. 14, there is no anti-trapping switch used for detecting an object between bottom door 13 and muffle frame 60, in contrast with the preceding examples of embodiment. On the contrary, anti-trapping device 64 is in a signal connection with an optoelectronic sensor device 83. Sensor device 83 is arranged on front face 59 of muffle frame 60 outside ring seal 61. Sensor device 83 has a transmitter, which transmits light rays in the direction of bottom door 13. The light rays are reflected on a reflection surface 85 provided on glass ceramic plate 57 back to the receiver of sensor device 83. Intermediate space 84 outside muffle opening 11 between upper side 16 of bottom door 13 and front face 59 of muffle frame 60 is thus monitored. If an object lies in intermediate space 84, the path of the light rays is impaired or interrupted. Since less light is thus picked up by the receiver of sensor device 83, anti-trapping device 64 can detect the object. Reflection surface 85 is provided in FIG. 14 by a special surface element, which is fixed on glass ceramic plate 87.

According to the sixth example of the embodiment of FIGS. 15 to 17, the cooking device has a front muffle opening 11, which can be closed by a linear or baking trolley door 13. The components of the cooking device, which correspond to those of the preceding high-level built-in cooking devices, are provided with the same reference numbers.

The cooking device is shown in the opened state in FIG. 15. Baking trolley door 13 is mounted in cooking device housing 1 in a displaceable manner by means of indicated telescoping rod 21. Like bottom door 13 of the first to fifth examples of embodiment, baking trolley door 13 of FIGS. 15 and 16 is also moved by means of an electric motor 29 arranged in housing 1.

An enlarged cut-out of the cooking device along line V-V from FIG. 15 is shown in FIG. 16. It follows from this that front face 59 of muffle frame 60 is not designed flat, but in a stepped form with two front faces 87 and 89 facing baking trolley door 13. In order to prevent trapping of a body part projecting from outside into cooking space 7 between muffle frame 60 and baking trolley door 13, switch lever 63 is arranged in the outer projecting front face 87. Switch lever 63 projects through lead-through opening 65 into the housing interior. A switch shoulder bent back at right angles at the end of switch lever 63 is formed in the housing interior. Said switch shoulder is in contact with tripping pin 67 of anti-trapping device 64. In addition, the switch shoulder is in contact with a pretensioned spring 91 in order to pretension the switch lever in its non-actuated position.

The closing procedure of baking trolley door 13 shown opened in FIGS. 15 and 16 into its closed position shown in FIG. 17 is described in the following. In accordance with the preceding examples of embodiment, baking trolley door 13 is moved by means of electric motor 29 in contact with ring seal 61, until limit switch 39 switches off electric motor 29. In the closed position, bottom door 13 compresses ring seal 61 with a certain pressing force over first compression depth $x_1$. Due to the large contact area between ring seal 61 and front face 16 of bottom door 13, however, first compression depth $x_1$ is correspondingly small. Switch lever 63 is not therefore actuated by baking trolley door 13 in the closed position. On the contrary, the limit switch switches off electric motor 29 in the closed position of bottom door 13 independently of anti-trapping device 64. According to the block diagram shown in FIG. 9, the limit switch conveys switch signal $S_2$ to control device 71. Control device 71 then switches off electric motor 29. In this case, bottom door 13 is pressed in its closed position with a prescribed force against front face 59 of muffle frame 60.

In the case of a body part projecting into muffle opening 11 during the closing procedure, anti-trapping device 64 comes into use. For this, baking trolley door 13 presses the body part first into contact with switch lever 63, as a result of which anti-trapping device 64 detects the body part. According to the block diagram shown in FIG. 9, anti-trapping device 64 conveys switch signal $S_2$ to control device 71. Control device 71 then reverses the drive motion of electric motor 29. Electric motor 29 thus drives baking trolley door 13 in the opening direction. Trapping of the body part between bottom door 13 and muffle frame 60 is thus reliably prevented.

The seventh example of embodiment is described with the aid of FIG. 18. The seventh example of embodiment concerns a high-level built-in cooking device, which goes back to the high-level built-in cooking device according to the first example of embodiment. In contrast with the first example of embodiment, switch lever 63 does not run in one piece around muffle opening 11, but rather switch lever 63 has three switch levers 63*a,* 63*b,* 63*c* actuatable independently of one another, which convey switch signals to anti-trapping device 64 independently of one another when pressure is exerted. Anti-trapping device 64 detects not only the switch signals of the individual switch levers, but also a time lag between these switch signals. Depending on the detected time lag, anti-trapping device 64 determines whether an object is trapped or whether linear door 13 is in its closed position.

A high-Level built-in cooking device according to the eighth example of embodiment is shown in FIG. 19. In this example of embodiment, the anti-trapping switch is on the other hand designed as a rubber hollow section 93, which is arranged on front face 59 of muffle frame 60. Electrically conductive contact elements 97 lying opposite one another are located in hollow space 95 of rubber hollow section 93. Contact elements 97 are in connection with anti-trapping device 64 via signal lines. When bottom door 13 is open, electrical contact faces 97 are spaced apart from one another, as a result of which no electrical current is conducted. When pressure is exerted by an object or by bottom door 13, electrical contact faces 97 come into contact with one another. A corresponding switch signal is thus conveyed to anti-trapping device 64, as a result of which anti-trapping device 64 can deduce that there is an object between bottom door 13 and muffle frame 60 or that the bottom door is in its closed position.

What is claimed is:

1. A cooking device including a muffle bounding a cooking space, the cooking space accessible through a muffle opening, a substantially linear door driven by a drive unit for opening and closing the door to open and close the muffle opening, the door including a surface facing the cooking space opposite of a front face of a muffle frame surrounding the muffle opening, comprising:

an anti-trapping device which detects an object outside of said muffle opening between said door surface and said front face of said muffle frame; and said anti-trapping device preventing trapping of said detected object by controlling said drive device, said anti-trapping device including an anti-trapping switch arranged on said front face of said muffle frame for providing signals to said anti-trapping device and said anti-trapping switch formed on said muffle frame around a substantial portion of said muffle opening accessible to an operator of said cooking device.

2. The cooking device according to claim 1, including said drive unit having a limit switch which switches off said drive unit independently of said anti-trapping device when said door is in the closed position.

3. The cooking device according to claim 1, including said anti-trapping switch including an optoelectronic sensor for monitoring said space between said door surface and said muffle front face and providing a signal to said anti-trapping switch for controlling said drive unit when an object is detected.

4. The cooking device according to claim 1, including said anti-trapping switch formed on said muffle frame around substantially all of said muffle opening accessible to an operator of said cooking device.

5. A cooking device including a muffle bounding a cooking space, the cooking space accessible through a muffle opening, a substantially linear door driven by a drive unit for opening and closing the door to open and close the muffle opening, the door including a surface facing the cooking space opposite of a front face of a muffle frame surrounding the muffle opening, comprising:

an anti-trapping device which detects an object outside of said muffle opening between said door surface and said front face of said muffle frame; and said anti-trapping device preventing trapping of said detected object by controlling said drive device, said anti-trapping device including an anti-trapping switch arranged on said front face of said muffle frame for providing signals to said anti-trapping device, said anti-trapping switch formed from a plurality of independent switch elements, said elements independently of one another providing signals to said anti-trapping device when pressure is exerted on one or more of the switches and said anti-trapping device detecting a time lag between said switch element signals to determine if said door is in the closed position or if a trapped object has been detected.

6. A cooking device including a muffle bounding a cooking space, the cooking space accessible through a muffle opening, a substantially linear door driven by a drive unit for opening and closing the door to open and close the muffle opening, the door including a surface facing the cooking space opposite of a front face of a muffle frame surrounding the muffle opening, comprising:

an anti-trapping device which detects an object outside of said muffle opening between said door surface and said front face of said muffle frame; and said anti-trapping device preventing trapping of said detected object by controlling said drive device, said anti-trapping device including an anti-trapping switch arranged on said front face of said muffle frame for providing signals to said anti-trapping device and said anti-trapping switch forming a substantial portion of a peripheral edge of said muffle opening.

7. The cooking device according to claim 6, including said anti-trapping switch formed on said muffle frame around substantially all of said muffle opening accessible to an operator of said cooking device.

8. A cooking device including a muffle bounding a cooking space, the cooking space accessible through a muffle opening, a substantially linear door driven by a drive unit for opening and closing the door to open and close the muffle opening, the door including a surface facing the cooking space opposite of a front face of a muffle frame surrounding the muffle opening, comprising:

an anti-trapping device which detects an object outside of said muffle opening between said door surface and said front face of said muffle frame; and said anti-trapping device preventing trapping of said detected object by controlling said drive device, said anti-trapping device having an adjustable switch lever which actuates said anti-trapping device when the predetermined pressure level is exerted; and including a lead-through opening formed in said front face of said muffle frame and said switch lever is coupled to said anti-trapping device through said opening.

9. The cooking device according to claim 8, including a seal formed around said muffle opening on said front face of said muffle frame.

10. The cooking device according to claim 9, including said lead-through opening is formed outside of said seal.

11. The cooking device according to claim 10, including said seal having a thickness and said anti-trapping switch including a front face facing said door surface at a distance substantially about two millimeters less than said seal thickness.

12. The cooking device according to claim 11, including said anti-trapping switch is actuated when a minimum compression depth of said seal is exceeded due to a trapped object or said door being closed.

13. A cooking device including a muffle bounding a cooking space, the cooking space accessible through a muffle opening, a substantially linear door driven by a drive unit for opening and closing the door to open and close the muffle opening, the door including a surface facing the cooking space opposite of a front face of a muffle frame surrounding the muffle opening, comprising:

an anti-trapping device which detects an object outside of said muffle opening between said door surface and said front face of said muffle frame; and said anti-trapping device preventing trapping of said detected object by controlling said drive device, said anti-trapping device including an anti-trapping switch arranged on said front face of said muffle frame for providing signals to said anti-trapping device, including said anti-trapping switch formed as a hollow elastomeric section with at least one pressure chamber formed therein and said anti-trapping switch senses the pressure increase on said hollow elastomeric section to distinguish whether said pressure increase is due to a heating effect from said cooking space or to a trapped object.

14. The cooking device according to claim 13, including said hollow elastomeric section forms a seal between said door surface and said muffle frame front face.

15. The cooking device according to claim 13, including said anti-trapping switch including at least at least a pair of opposing spaced apart electrically conductive contact elements which come in contact with one another when sufficient pressure is exerted and send a switch signal to said anti-trapping switch when they contact one another.

* * * * *